US008157463B2

(12) United States Patent
McBratney et al.

(10) Patent No.: US 8,157,463 B2
(45) Date of Patent: Apr. 17, 2012

(54) EXTENDED BRISTLES

(75) Inventors: Jeff R McBratney, Carson City, NV (US); Roberta L Tracz, Carson City, NV (US)

(73) Assignee: Jeff McBratney, Carson City, NV (US)

( * ) Notice: Subject to any disclaimer, the term of this patent is extended or adjusted under 35 U.S.C. 154(b) by 0 days.

(21) Appl. No.: 12/803,239

(22) Filed: Jun. 22, 2010

(65) Prior Publication Data

US 2011/0311295 A1 Dec. 22, 2011

(51) Int. Cl.
*A46B 11/00* (2006.01)

(52) U.S. Cl. ..... 401/127; 401/126; 401/129

(58) Field of Classification Search ..... 401/127, 401/126, 128, 129
See application file for complete search history.

(56) References Cited

U.S. PATENT DOCUMENTS

| | | | | |
|---|---|---|---|---|
| 4,525,090 | A * | 6/1985 | Riley et al. | 401/127 |
| 5,096,320 | A * | 3/1992 | Norman et al. | 401/127 |
| 5,116,154 | A * | 5/1992 | Fulkerson | 401/127 |
| 6,872,020 | B2 * | 3/2005 | Epli | 401/127 |

* cited by examiner

*Primary Examiner* — David Walczak

(57) ABSTRACT

"Extended Bristles" is a application tool that replaces a standard nail polish brush and cap to obtain the complete contents of nail polish by pushing the top plunger cap, which slides over a spring and lower cap and immerses the bristles to the bottom of the bottle. The plunger cap which is attached to the plunger shaft and bristles has a spring located between upper and lower cap around the plunger shaft that retracts when application is completed. The brush is able to extend to the bottom of the bottle when the cap is closed securely or when it is resting unsecured at top of polish bottle. By using the entire contents of the bottle of nail polish the only remaining part is the glass bottle which will not pollute the ground or environment.

1 Claim, 1 Drawing Sheet

Fig. 1
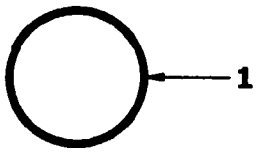
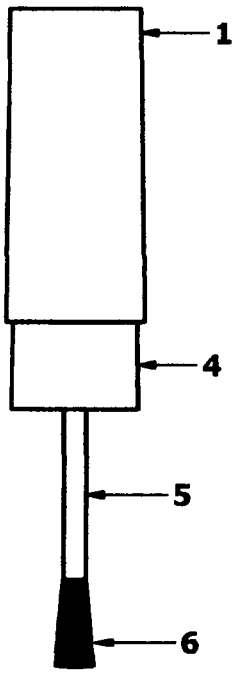
Fig. 2
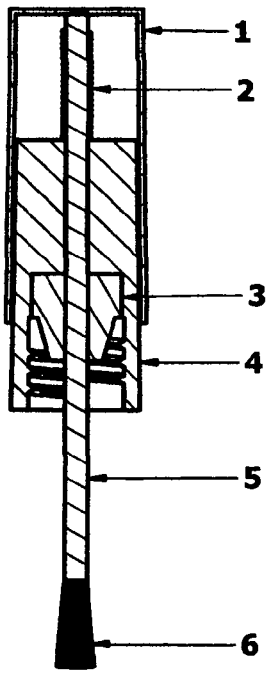
Fig. 4
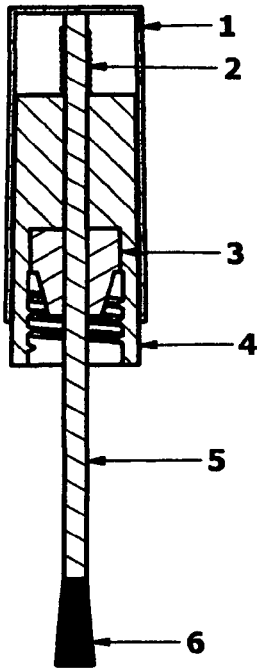
Fig. 5
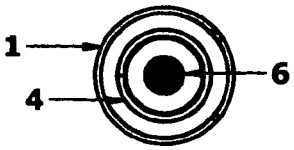
Fig. 3

EXTENDED BRISTLES

RELATED PRIOR ART

A search of prior art did not disclose any patents that read directly on the claims of: Bristle shaft is long enough to obtain contents of bottle if unthreaded resting on bottle throat.

U.S. Pat. No. 6,789,970 discribing a threadedly removable cap.

U.S. Pat. No. 4,961,664 discribing a nail polish container with movable brush.

U.S. Pat. No. 6,164,857 discribing an extended applicator.

BACKGROUND OF THE INVENTION

Nail polish applicator with extendable shaft, plunger cap, and spring, enables the user to apply nail polish at lowest points of the container even when secured by threading or unsecured and resting on bottle throat. When not in use, in secured mode, bristles remains seperate from bottom of bottle. By finishing the complete contents of the bottle only the empty glass container will be discarded so as to not pollute the earth with remaining lacquer.

SUMMARY

The invention is a threaded sealed cap, combined with plunger cap, and spring, assembled to a shaft and bristles to be housed in a nail polish bottle.

BRIEF DESCRIPTION OF DRAWINGS

FIG. 1. of 5. is a top view of a retracted extendable applicator.

FIG. 2. of 5. is a side view of an extendable applicator.

FIG. 3. of 5. is a bottom view of bristles, shaft, and caps.

FIG. 4. of 5. is a cross sectional view of the extendable applicator with reference numbers for the detailed description in a retractable position.

FIG. 5. of 5. is a flow section of the extendable applicator in an extended position.

DETAILED DESCRIPTION OF INVENTION

This invention is an extendable applicator to be attached internally with an externally threaded container of nail polish or nail lacquer.

"EXTENDED BRISTLES" comprises of an upper plunger cap, round cylinder with flat top, 1., fitted over a base cap, 4., with a slight clearance between caps for motion purposes and guideance. Bristles, 6., are located at bottom of plunger shaft for application. The plunger shaft, 5., has a coil spring, 2., surrounding it. This spring, 2., is located between plunger cap, 1., and base cap, 4., for vertical movement downward for obtaining nail polish or upwards to a stationary position. Keeping the bristles, 6., away from the bottom of the bottle prevents bending or damage to the bristles, 6.

The base cap, 4., comprising of threads and beveled seal, 3., are the main objective for securing the bottle from leakage. The plunger cap, 1., shaft, 5., with spring, 2., are pressed downward. The shaft, 5., goes through a shaft opening on the seal, 3., of the base cap, 4., to let the bristles obtain nail polish.

When the plunger cap, 1., which is attached to plunger shaft, 5., and bristles, 6., is pressed in a downward motion the bristles, 6., are able to obtain complete contents of polish whether the base cap, 4., is secured in a sealed position of bottle or in an unsecured position resting on the throat of bottle.

The invention claimed is:

1. A nail polish applicator comprising:

a container having a throat for containing nail polish therein and a cap for closing the container, said cap comprising:

an upper plunger cap;

a base cap threadedly secured to the throat of the container wherein the upper plunger cap has a hollow portion that at least partially surrounds an outer surface of the base cap such that the upper plunger cap is slidably disposed over the base cap;

a seal disposed in the base cap for sealing the container;

a plunger shaft having an upper end secured to an inner surface of the upper plunger cap and a lower end having a nail polish applicator attached thereto; and a spring positioned between the inner surface of the upper plunger cap and an upper surface of the base cap;

wherein the plunger shaft extends through the spring, base cap and seal such that when the base cap is fully threaded onto the throat of the container and the upper plunger cap is depressed, the upper plunger cap slides along the outer surface of the base cap and thereby depresses the plunger shaft such that the applicator extends to a bottom inner surface of the container and wherein when the base cap is unthreaded from the container and resting on the throat of the bottle and the upper plunger cap is depressed, the upper plunger cap also slides along the base cap and thereby depresses the plunger shaft such that the applicator extends to the bottom inner surface of the container.

* * * * *